United States Patent [19]

Smith et al.

[11] Patent Number: 4,968,392

[45] Date of Patent: Nov. 6, 1990

[54] TREATMENT OF CONDENSER TUBES

[75] Inventors: Susan Smith, Didcot; Roger Francis, Oxford; Clive Barnes, Cumnor, all of England

[73] Assignee: BNF Metals Technology Centre, Wantage, England

[21] Appl. No.: 259,361

[22] Filed: Oct. 14, 1988

[30] Foreign Application Priority Data

Apr. 28, 1988 [GB] United Kingdom ..... 8810083
Apr. 28, 1988 [GB] United Kingdom ..... 8710011

[51] Int. Cl.[5] ..... C25D 9/06; C23C 22/05

[52] U.S. Cl. ..... 204/56.1; 148/243; 148/267

[58] Field of Search ..... 204/32.1, 56.1, 140; 148/243, 267

[56] References Cited

U.S. PATENT DOCUMENTS 3,531,384 9/1970 Inouye ..... 204/56.1
3,899,366 8/1975 Tajkowski ..... 428/470

*Primary Examiner*—T. M. Tufariello
*Attorney, Agent, or Firm*—Wenderoth, Lind & Ponack

[57] ABSTRACT

The treatment of the external surfaces of condenser tubes, such as those used in power station condenser plants, with certain inorganic chemical compounds renders those surfaces or parts thereof sufficiently water-repellent so as to prevent the formation thereon, during operation of the condenser, of condensate films. Instead of continuous condensate films forming on the treated condenser tube surfaces during operation of the condenser, condensation is formed as discrete droplets of water which run down and drip off the tubes with the result that the condenser plant can work at higher levels of efficiency. Suitable chemical substances for use in the treatment of condenser tube surfaces include Cr VI anions, $Cr^{3+}$ ions, and alkali metal tungstates, vanadates and molybdates.

12 Claims, No Drawings

TREATMENT OF CONDENSER TUBES

The present invention relates to condenser tubes such as those used in power station condenser plants. More particularly, it relates to the chemical treatment of such tubes to improve the operational thermal efficiency thereof.

An important stage in the operation of a power station involves the condensation of steam, after it has passed through the turbine. This is traditionally achieved by bringing the steam, under vacuum, into contact with a vast array of metal tubes through which cool water is caused to flow. The cool water flowing through these condenser tubes extracts the heat of condensation from the steam or vapour at the tube exterior. Clearly the overall efficiency of the power station depends on the maximum heat transfer from the steam to the coolant being achieved. When the steam condenses on the external surfaces of the condenser tubing it forms a continuous film of condensate. It has already been recognised by the power generating industry that the presence of condensate films on the external surfaces of the condenser tubes is responsible for lowering the heat transfer efficiency of the condenser. Although much effort has been spent by the industry in trying to overcome this problem, no practical solutions have been found to date.

The present invention is based on the discovery that by treating the external surfaces of the condenser tube with certain inorganic substances, it is possible to impart to those surfaces a degree of water-repellency sufficient to prevent the formation thereon of condensate films. Thus, instead of condensation forming on such a treated tube surface in a "film-wise" manner, it forms thereon as discrete droplets of water (i.e. as "drop-wise" condensation) which, under gravity, run down and/or drip off the tube without forming any condensate film thereon. Since no continuous condensate film forms on the treated condenser tube surface, the working efficiency of the condenser plant can be maintained at higher levels than previously achieved.

According to one aspect, the present invention provides a method of improving the working efficiency of condenser tubing suitable for use in a power generating plant which comprises treating the external surface of the condenser tubing, or a part thereof, which surface has been previously cleaned and degreased, with an acidic aqueous solution of hexavalent chromium anions. Preferably the acidic solution of hexavalent chromium anions is a aqueous solution of chromic acid although acidic solutions of other chromates, such as potassium dichromate, may be used. When chromic acid is used, it is typically used at a concentration in the range of from 0.0025% to 10% by weight corresponding approximately to a $CrO_3$ concentration of from 0.025 to 10.0 $gl^{-1}$. Concentrations of greater than 10% by weight of chromic acid can be used in the practice of the present invention although because of the hazardous nature of chromic acid they are not preferred. At $CrO_3$ concentrations below about 0.0025% by weight, the treatment in general is somewhat limited in usefulness since condenser tube surfaces treated at such low $CrO_3$ concentrations tend to experience, during operation of the condenser, only small patches of "drop-wise" condensation. We have, however, noted that the treatment of condenser tubing formed of the alloy designated 72200 (ASTM) using a chromic acid concentration as low as 0.001% does produce a tubing surface that, during operation, allows condensation to form in a "drop-wise" manner. In general, we have found that the use of chromic acid solutions containing about 2% by weight $CrO_3$ gives good results in the practice of the present invention.

According to another aspect, the present invention provides a method of improving the working efficiency of condenser tubing suitable for use in a power generating plant which comprises treating the external surface of the condenser tubing, or a part thereof, which surface has been previously cleaned and degreased, with an aqueous acidic treatment solution comprising $Cr^{3+}$ ions and an oxidising agent to depolarize the surface of the condenser tubing. Typically, the concentration of the $Cr^{3+}$ ions in the treatment solution will be in the range of from 1.6 to 50 $gl^{-1}$, as the metal ion, and preferably in the range of from 1.6 to 10 $gl^{-1}$, as the metal ion. The source of $Cr^{3+}$ ions is not believed to be critical provided that the anion in the salt does not interfere with the reaction.

In view of its commercial availability, we prefer to use (as the source of $Cr^{3+}$ ions) chrometan, a commercially available basic chromic sulphate having the approximate stoichiometric formula $3Na_2SO_4.2Cr_2(SO_4)_3.Cr_2O_3.nH_2O$ where $n<1$ and which yields 1 $gl^{-1}$ chromic ion per 6.25 $gl^{-1}$. A typical treatment solution for use in this aspect will contain from 10 to 60 $gl^{-1}$ of chrometan. It is essential that the $Cr^{3+}$ treatment solution contains an oxidising agent to depolarize the surface of the condenser tubing being treated. Oxidising agents that are suitable will be ones that are stable in acidic conditions and which do not, of course, interfere with the reaction. For the sake of convenience, we prefer to use hydrogen peroxide as the oxidising agent in the treatment solution. The concentration of hydrogen peroxide used is typically in the range from 10 to 30 $ml/l^{-1}$. According to the above aspect, the aqueous treatment solution comprising $Cr^{3+}$ ions and the oxidising agent is acidic. Preferably the pH of this treatment solution will be in the range of from 2.5 to 4.

According to yet another aspect, the present invention provides a method of improving the working efficiency of condenser tubing suitable for use in a power generating plant which comprises treating the external surface of the condenser tubing, or a part thereof, which surface has been previously cleaned and degreased, with an aqueous solution, having a pH of not less than about 7, of a compound selected from alkali metal tungstates and alkali metal molybdates. We have additionally found that the method of the preceding aspect may be modified by using an aqueous treatment solution of a compound selected from alkali metal vanadates as an alternative to the use of an alkali metal tungstate or molybdate. However, when an alkali metal vanadate is used, the aqueous treatment solution should have a pH of not less than about 8.1. Preferably, in view of their availability, we prefer to use the sodium salts as the alkali metal salts above. Typical concentrations of sodium tungstate, sodium molybdate and sodium metavanadate useful in carrying out the invention according to this aspect are in the range of from 30 to 100 $gl^{-1}$. In addition to the above, we have found that the condenser tubing can be anodically charged while being immersed in the treatment solution according to a modification of the above-described method. For example, we have found that "dropwise" condensation forms on the surfaces of tubing that has been immersed in a treatment solution containing from 1 to 100 g/l of sodium tungstate, sodium molybdate or sodium metavanadate, having a pH of 13 and a temperature of about 85° C. while being anodically charged at a current density of about 15 mA/cm$^2$ for only 4 minutes.

It will be clear that the present invention, according to the various aspects, modifications and embodiments described above, relates to the chemical treatment of at least a part of the external surface or surfaces of condenser tubing (including sections thereof). Condenser tubing that can advantageously be treated according to the present invention includes tubing formed of alloys commonly used for the purpose such as cupronickel alloys (e.g. 90/10 and 70/30) and aluminium brasses and also tubing formed of less frequently used materials such as stainless steel (e.g. 316 stainless steel), titanium, and the alloy designated 72200 (ASTM) which consists of 15–18% Ni, about 0.4% Cr, about 0.5% Fe, about 0.5% Mn, about 0.006% C, up to 0.002% Si with the balance being Cu.

The treatments according to the various aspects and modifications described above are conveniently carried out by immersing a section of tubing in the treatment solution for a period of time typically not less than 1 hour, unless stated otherwise, to ensure that a reasonably long lasting surface effect on the condenser tubing is obtained. However, treatment times of less than 1 hour can be employed, especially in cases where high concentrations of $Cr^{VI}$ are used.

Prior to immersion in the treatment solution, the surface or surfaces of the condenser tubing to be treated require cleaning and degreasing. In this respect, we have found that a light abrasion of the surface followed by degreasing with a suitable organic solvent such as acetone will, in general, suffice. However, better results are obtained if, after degreasing, the surface or surfaces to be treated are further cleaned with dilute hydrochloric acid, such as by immersion for up to about 30 minutes, before the tubing is transferred into the treatment solution.

The temperature of the treatment solution during immersion therein of the condenser tubing is not critical. Generally the treatment solution during immersion of the condenser tubing will be maintained at a temperature within the range of from about 5° to about 70° C. In most cases, however, the treatment solution will be used at room temperature since any advantages achieved by operation at higher temperatures are not particularly significant when the costs of heating treatment solutions above room temperature are taken into account.

According to the aspect of the invention using a treatment solution containing $Cr^{VI}$ anions, as stated above, the treatment solution is acidic. In the preferred embodiment of this aspect, the source of $Cr^{VI}$ anions is chromic acid itself in which case there is no need to adjust the pH of the solution. According to the aspect where the treatment solution is preferably a solution of chrometan and hydrogen peroxide, the solution pH is preferably maintained at a value of from about 2.5 to about 4. With reference to the aspect of the invention using treatment solutions containing a tungstate, molybdate or vanadate salt, the solution pH is maintained at a value not less than about 7 in the case of tungstates and molybdates and at a value of not less than 8.1 in the case of vanadates since simple immersion of the condenser tubing in treatment solutions having lower pH value does not give the desired results. Preferably, the tungstate, molybdate or vanadate solution is prepared by dissolving the salt into a caustic soda solution having a pH value of about 13 and then, if desired, adjusting the pH of the treatment solution to a value of not lower than the above defined minimum values.

Despite the above-described limitation of pH in the use of tungstate or molybdate - containing treatment solutions, we have found that it is posible to treat condenser tubing in such solutions having pH values as low as about 4 if, during immersion in the treatment solution, the condenser tubing is cathodically charged. Thus, according to a further aspect, the present invention provides a method of improving the working efficiency of a section of condenser tubing suitable for use in a power generating plant which comprises immersing the section of condenser tubing, the surface of which has been previously cleaned and degreased, in an aqueous solution of a compound selected from alkali metal tungstates and alkali metal molybdates having a pH of from about 4 to about 7, providing an anode and, as cathode, the section of condenser tubing, and passing an electric current between the anode and the condenser tubing. The composition of the treatment solution, the temperature of the solution during treatment and time of treatment according to this aspect will typically be as described above in respect of the other aspects and embodiments of the invention. According to a preferred embodiment, the external surface of the section of tubing is abraded, degreased with acetone and then cleaned in 25% HCl after which it is cathodically charged at −800 mV (Pt) for a period of from 1 to 6 hours at room temperature.

According to the present invention, the chemical or electrochemical treatment of the condenser tubing surface is believed to result in the deposition thereon of a mixed metal oxide layer containing metal oxide derived from the metal ions in the treatment solution (i.e. Cr, W, Mo or V) and metal oxide derived from the metal(s) of which the condenser tubing is formed. The mixed metal oxide layer is believed to have a thickness of less than about 0.1$\mu$ and does not, therefore, significantly affect the thermal conductivity of the wall of the condenser tubing on which it has been deposited. The mixed metal oxide layers have the property inducing the formation of condensation of steam on its surface in a "drop-wise" manner although the surface effects that give rise to this phenomenon are not understood. We have found, however, that certain other types of coatings that can be deposited on metal surfaces for the purpose of improving the corrosion resistance thereof, such as phosphate, nickel oxide, silicate and titanium dioxide coatings, do not seem to have this property. In addition to the above characteristics and advantages, the metal oxide layers deposited according to the invention impart corrosion resistance to the condenser tubing while being, themselves, resistant to corrosion over long periods of exposure to steam. In cases where the tubing is formed of a copper-containing alloy, the deposited oxide layers are sufficiently resistant to prevent the formation on the tubing surface of cupric oxide which does not have the property of inducing condensation from steam in a "drop-wise" manner. The deposited oxide layers are also capable of withstanding the thermal shock that occurs as steam condenses. This property is believed to result from an impregnation of the metal oxide into the metal surface of the condenser tubing.

EXAMPLES

EXAMPLE 1

A tube of an alloy comprising 90% Cu 10% Ni (90/10) was prepared by subjecting the external surface to light abrasion followed by degreasing with acetone. The tube was then immersed in a 2% solution of chromic acid for 1 hour at room temperature. After treatment the tube was rinsed with water. After 3 hours of operation in a condenser unit, steam was still condensing onto the surface of the treated tube in a "drop-wise" manner. Similar sections of tube that had not been treated were covered with a condensate film.

EXAMPLE 2

A tube formed of 90/10 alloy was prepared as in Example 1 and then immersed in 10% chromic acid at room temperature for 5 minutes. The tube, without any rising step, was operated in a condenser unit for 3 hours after which time, condensation was still formed in a drop-wise manner on the tube surface although some areas of film-wise condensation also occurred.

EXAMPLE 3

A tube of 90/10 alloy was treated as in Example 1 except that the chromic acid solution had a concentration of 0.0025% by weight of $CrO_3$. The treated tube when operated in a condensation unit was found to have some areas of drop-wise condensation and some areas of film-wise condensation on its surface.

EXAMPLE 4

A tube of 90/10 alloy was lightly abraided, degreased with acetone and then immersed in 25% HCl for 30 secs. The tube was then anodically charged at a current density of 15 $mA/cm^{-2}$ in a solution of 1 g/l $NaVO_3$ and 150 g/l NaOH (pH ~13) at 85° C. for 4 mins. The tube was operated in a condenser unit for 3 hours after which time, some areas of dropwise condensation and some areas of filmwise condensation occurred on its surface.

EXAMPLE 5

A tube of 90/10 alloy was lightly abraided, degreased in acetone and then immersed in 25% HCl. The tube was then cathodically charged at −800 mV (Pt) in 110 g/l $Na_2WO_4pH_4$ for 1 hour at room temperature. After 2¼ hours there occurred a patch of dropwise condensation and filmwise condensation on the tube surface.

EXAMPLE 6

A tube of 70/30 Cu/Ni alloy was lightly abraided, degreased in acetone and then immersed in Chrometan Solution (10 $gl^{-1}$ with 10 ml/l of $H_2O_2$) at 70° C. for four hours. After several hours, some areas of dropwise and some areas of filmwise condensation occurred on its surface.

EXAMPLE 7

A coating solution of 60 g/l of chrometan was raised to pH 2.5 by the addition of small quantities of NaOH with stirring. 10 ml of $H_2O_2$ were added to 1 liter of this solution. A tube formed of 90/10 Cu/Ni alloy was abraided, degreased with acetone and then cleaned in 10% HCl for 30 minutes. The cleaned and degreased alloy tube was then immersed in the above chrometan solution for 3 hours at room temperature. The tube when operated in a condenser unit was found to have some areas of dropwise condensation on its surface.

EXAMPLE 8

A tube formed of 90/10 Cu/Ni alloy was abraided, degreased with acetone and cleaned with 10% HCl for 30 minutes. The tube was then immersed in a solution containing 0.1M $NaVO_3$, pH 8.1 for 1 hour at 40° C. After treatment, the tube was operated in a condenser unit for 4¾ hours. After this operation, some condensation was still forming in a dropwise manner on the surface of the tube.

EXAMPLE 9

A tube formed of 90/10 Cu/Ni was abraided, degreased with acetone and then cleaned in 25% HCl. It was then treated by immersion in a solution containing 0.1M $Na_2WO_4$, pH 7 at room temperature for 1 hour. Under test in a condenser unit, the treated tube was found to have on its surface a mixture of filmwise and dropwise condensation.

EXAMPLE 10

A tube formed of 90/10 Cu/Ni was cleaned and degreased in accordance with the procedure in Example 9. The tube was then immersed in a solution containing 0.1M sodium molybdate, pH 7 at room temperature for 1 hour. After being tested for two hours in a condensation unit, the treated tube still had some dropwise condensation on its surface.

EXAMPLE 11

A tube formed of 90/10 Cu/Ni alloy was cleaned and degreased according to the procedure of Example 9. The tube was then immersed in a solution containing 1 g/l of sodium molybdate and 150 g/l NaOH (pH 13) and anodically charged with a current density of 15 mA $cm^{-2}$ in the solution at a temperature of 85° C. for 4 minutes. After treatment, the tube under operation in the condenser unit was found to have some areas of dropwise condensation on its surface.

EXAMPLE 12

The procedure of Example 11 was repeated except that the treatment solution contained 1 g/l of sodium tungstate instead of the molybdate. The treated tube, after testing in the condenser unit, was found to have dropwise condensation over most of its surface.

EXAMPLE 13

The procedure of Example 5 was repeated except that the treatment solution contained 110 g/l of sodium molybdate instead of the tungstate. Patches of dropwise condensation formed on the surface of the treated tube on testing.

We claim:

1. A method of improving the working efficiency of condenser tubing suitable for use in a power generating plant which comprises treating the external surface of the condenser tubing, or a part thereof, which surface has been previously cleaned and degreased, with an acidic aqueous treatment solution comprising $Cr^{3+}$ ions in a concentration in the range of from 1.6 to 50 $gl^{-1}$, as the metal ion, and an oxidizing agent to depolarize the surface of the condenser tubing.

2. The method according to claim 1, wherein the concentration of the $Cr^{3+}$ ions in the treatment solution lies within the range of from 1.6 to 10 $gl^{-1}$, as the metal ion.

3. A method according to claim 1, wherein the source of the $Cr^{3+}$ ions is chromic sulphate.

4. The method according to claim 1, wherein the treatment solution contains, as oxidizing agent, hydrogen peroxide at a concentration in the range of from 10 to 30 $ml/l^{-1}$.

5. The method according to claim 4, wherein the treatment solution has a pH in the range of from 2.5 to 4.

6. The method according to claim 2, wherein the source of $Cr^{3+}$ ions is chromic sulphate.

7. A method of improving the working efficiency of condenser tubing suitable for use in a power generating plant which comprises treating the external surface of the condenser tubing, or a part thereof, which surface has been previously cleaned and degreased, with an aqueous solution, having a pH or not less than about 7, of sodium tungstate at a concentration within the range of from 30 to 100 $gl^{-1}$ or of sodium molybdate at a concentration within the range of from 30 to 100 $gl^{-1}$.

8. The method according to claim 7, wherein the condenser tubing is anodically charged while being immersed in the treatment solution.

9. The method of improving the working efficiency of condenser tubing suitable for use in a power generating plant which comprises treating the external surface of the condenser tubing, or a part thereof, which surface has been previously cleaned and degreased, with an aqueous solution, having a pH or not less than about 8.1, of sodium metavanadate at a concentration in the range of from 30 to 100 $gl^{-1}$.

10. The method according to claim 9, wherein the condenser tubing is anodically charged while being immersed in the treatment solution.

11. A method of improving the working efficiency of a section of condenser tubing suitable for use in a power generating plant which comprises immersing the section of condenser tubing, the surface of which has been previously cleaned and degreased, in an aqueous solution containing from 30 to 100 $gl^{-1}$ of sodium tungstate or from 30 to 100 $gl^{-1}$ of sodium molybdate, having a pH of from about 4 to about 7, providing an anode and, as cathode, the section of condenser tubing, and passing an electric current between the anode and the condenser tubing.

12. The method according to claim 11, wherein the section of condenser tubing is cathodically charged at about −800 mV (Pt) for a period of from 1 to 6 hours at ambient temperature.

* * * * *